United States Patent [19]

Jørgensen

[11] 4,008,882

[45] Feb. 22, 1977

[54] MIXING UNIT FOR MIXING AND/OR TREATING FLUID MATERIALS

[75] Inventor: Povl Jørgen Jørgensen, Vedbaek, Denmark

[73] Assignee: Rotostat I/S, Copenhagen, Denmark

[22] Filed: Mar. 17, 1975

[21] Appl. No.: 559,031

[30] Foreign Application Priority Data

Mar. 26, 1974 Denmark ..... 1662/74

[52] U.S. Cl. ..... 259/2; 259/9; 259/DIG. 31

[51] Int. Cl.² ..... B01F 15/00; B01F 7/02

[58] Field of Search ..... 259/2, 8, 9, 10, 85, 259/DIG. 31; 415/147, 160; 416/124, 126

[56] References Cited

UNITED STATES PATENTS

| | | | |
|---|---|---|---|
| 2,203,843 | 6/1940 | Pierce | 415/147 X |
| 2,400,202 | 5/1946 | Kelderhouse | 259/DIG. 31 |
| 3,195,867 | 7/1965 | Mould, Jr. | 259/9 |
| 3,460,748 | 8/1969 | Erwin | 415/147 |

*Primary Examiner*—Edward J. McCarthy
*Attorney, Agent, or Firm*—Dressler, Goldsmith, Clement, Gordon & Shore, Ltd.

[57] ABSTRACT

A mixing unit for mixing and/or treating of fluid materials. The unit comprises a driven inner rotor mounted within an outer housing for rotation relative thereto. The outer housing is carried rotatably on the inner rotor or its drive shaft and has further a part or parts protruding from its periphery for restraining the rotation of the outer housing in the material to be mixed and/or treated. The protruding parts may be inclined to the axis of rotation and thereby act as blades on a propeller-mixer. At least the periphery of the outer housing with the protruding parts thereon may form an integral part interchangeable within a series of similar parts.

4 Claims, 4 Drawing Figures

MIXING UNIT FOR MIXING AND/OR TREATING FLUID MATERIALS

Figure 1:
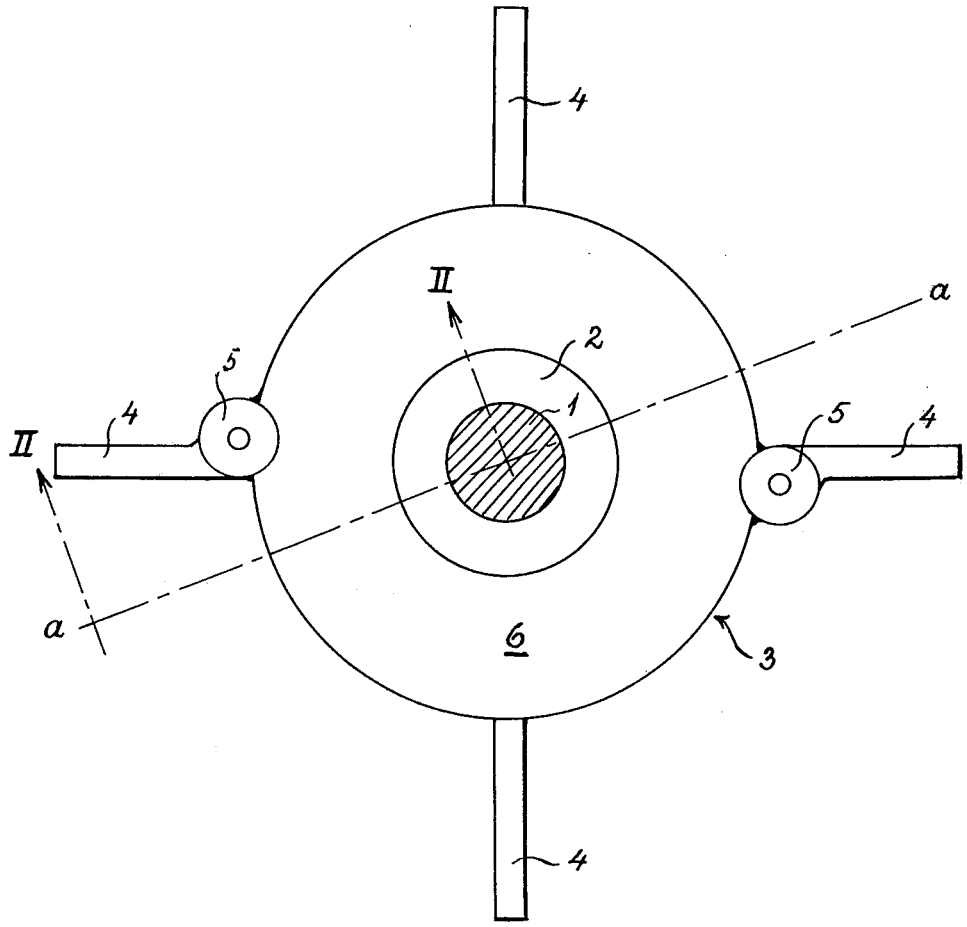

This invention relates to a mixing unit for mixing and/or treating fluid materials, comprising an outer housing having an inner rotor mounted for rotation relative to said housing on a drive shaft connected to a driving means, said rotor being arranged by rotation relative to the outer housing to throw or press out the fluid material to be mixed and/or treated against a cutting, crushing or in any other way friction-producing member in or adjacent to the periphery of the outer housing.

Known mixing units of the type mentioned above comprise a driving means such as an electric motor in the form of a flanged motor the flange of which is rigidly connected to the outer housing by means of a supporting structure or frame constructed of a plurality of tubes or rods, the drive shaft extending centrally through the frame and being coupled directly to the electric motor.

Apparatuses of this kind are particularly suitable for treating viscous fluid materials, being e.g. applicable to mixing a fluid with one or more other fluids, mixing a fluid with solids, mixing fluids with gases, and, in addition to mixing, being capable of effecting a treatment of the fluid material in the form of disintegration, dispersion, homogenization, etc.

Prior art apparatuses of the said kind present several disadvantages. Thus, the cleaning of the part immersed in the fluid material is rather difficult and time-consuming on account of the frame which is rigidly connected to the outer housing, and this may give rise to considerable difficulties, especially when the mixing unit is used for treating foods or pharmaceutical products where high standards of hygiene and purity are required of the finished product. Another disadvantage inherent in such known mixing units is that their length cannot be readily adapted to the height of the mixing vessel in which they are to be used, such adaption in fact only being possible by exchanging the frame and the drive shaft. In practice, therefore, with a mixing unit of this type it is necessary always to use a mixing vessel of one and the same size in connection with the mixing unit. This is a substantial drawback when varying quantities are to be mixed.

It is the object of this invention to provide a mixing unit of the type initially stated which may readily be cleaned after use, the length of which may be adapted to suit actual requirements, and which without losing any useful properties is far more simply constructed than known mixing units and therefore may be produced at a lower cost.

According to the invention this is achieved by supporting said outer housing for free rotation on said rotor and/or said drive shaft, and by providing at least one part protruding from the periphery of said housing, said protruding part or parts being adapted to restrain the rotation of said outer housing in said fluid material.

By this arrangement of the mixing unit the frame connecting the outer housing with the driving means becomes completely unnecessary and, consequently, the aforesaid drawbacks inherent in prior art mixing units are also eliminated. In the mixing unit according to the invention the length of the drive shaft between the driving means and the mixing means may readily be altered to any desired size, either by exchanging the drive shaft for another shaft of the desired length or by having the drive shaft adapted to telescoping and to be fixedly secured in any desired position. Alternatively, the drive shaft may be passed through a hollow shaft in the driving means and arranged to be fixedly secured relative thereto. The actual design as regards size and shape of the parts protruding from the periphery of the housing, the so-called blades, with a view to providing the necessary amount of restraint of the rotation of the outer housing for obtaining the desired mixing and/or treating of a given fluid material will be obvious to a person skilled in the art from the above disclosure, such design in each individual case being based on experiments and empirical judgment. Besides overcoming the aforesaid drawbacks inherent in prior art mixing units, the mixing unit according to the invention offers further advantages in other respects. Thus, in addition to the mixing and/or treatment aimed at, which is caused by the rotation of the rotor relative to the outer housing, a stirring effect is obtained resulting from the rotation of the housing in the fluid material, whereby the housing with the protruding blades thereon acts as a per se known impeller. Thereby a further mixing or stirring of the fluid material is obtained, which is not obtainable with mixing units of the prior art type as initially mentioned. The mixing unit according to the invention may in a given situation be used primarily as an impeller, the above stated details of the invention in this case acting as a hydraulic gear reducing the speed of rotation of the outer housing with the blades thereon in relation to the speed of rotation of the drive shaft. Finally, the mixing unit according to the invention has an inherent security against damage to the outer housing and/or the inner rotor caused by wedging of solids therebetween. In prior art mixing units of the aforesaid type such wedging may cause destruction of or damage to the outer housing or the inner rotor or both, whereas such wedging in the mixing unit according to the invention will only cause the rotation of the drive shaft to be wholly transmitted to the outer housing, whereafter the mixing unit will act exclusively as an impeller of the type mentioned above, and the components of the mixing head will suffer no damage.

In a first embodiment of the mixing unit according to the invention the part(s) protruding from the periphery of the outer housing is planar and inclined at an oblique angle to the common axis of rotation of the housing and the drive shaft in such a way that when the outer housing rotates relative to the fluid material it they will impart an upward or downward movement to said material relative to the mixing unit by acting as a helicoid or propeller.

This embodiment of the mixing unit according to the invention adds the further function of a propeller impeller to that of mixing and/or treating of the fluid material primarily aimed at and thereby imparts to the material a vertical movement which is highly desirable in many mixing and/or treating processes, said movement causing new portions of the material to be continually fed to the primary treatment in the mixing head. If desired, this stirring may be the treatment primarily aimed at, as hereinbefore described.

In another embodiment of the mixing unit, wherein the outer housing is arranged so that its various parts may be readily disassembled, at least the part comprising the periphery of the housing having the protrusions thereon is interchangeable with another corresponding part within a series of such parts.

With a view, among other things, to the cleaning of prior art mixing units of the type initially mentioned, it is known to arrange the outer housing so that it can be readily disassembled in several components. When the mixing unit according to the invention is furthermore so arranged as indicated in the foregoing, a number of advantages may be obtained. Thus, for a given treatment process a part may be chosen for the mixing unit, the protruding blades of which having a size and shape suitable for the treatment process in question and for the viscosity of the particular fluid material to be treated. Also, depending upon what is most expedient in the particular case, a choice may be made between a part with straight (vertical) blades or a part with inclined blades and, finally, depending upon the particular kind of treatment to which the fluid material is to be subjected, a choice may be made between parts having different forms of aperture or apertures in the outer housing. Beyond having the effect that a mixing unit according to the invention may readily be rearranged from one mixing job to another and therefore gains a very wide field of application, the indicated features also result in advantages in connection with manufacturing and the maintaining of a stock of mixing units according to the invention, whereby mixing units for widely different purposes may be constructed from a small number of standard parts. It should be noted too that the indicated features are also advantageous in connection with replacing worn parts of the mixing unit.

Figure 2:
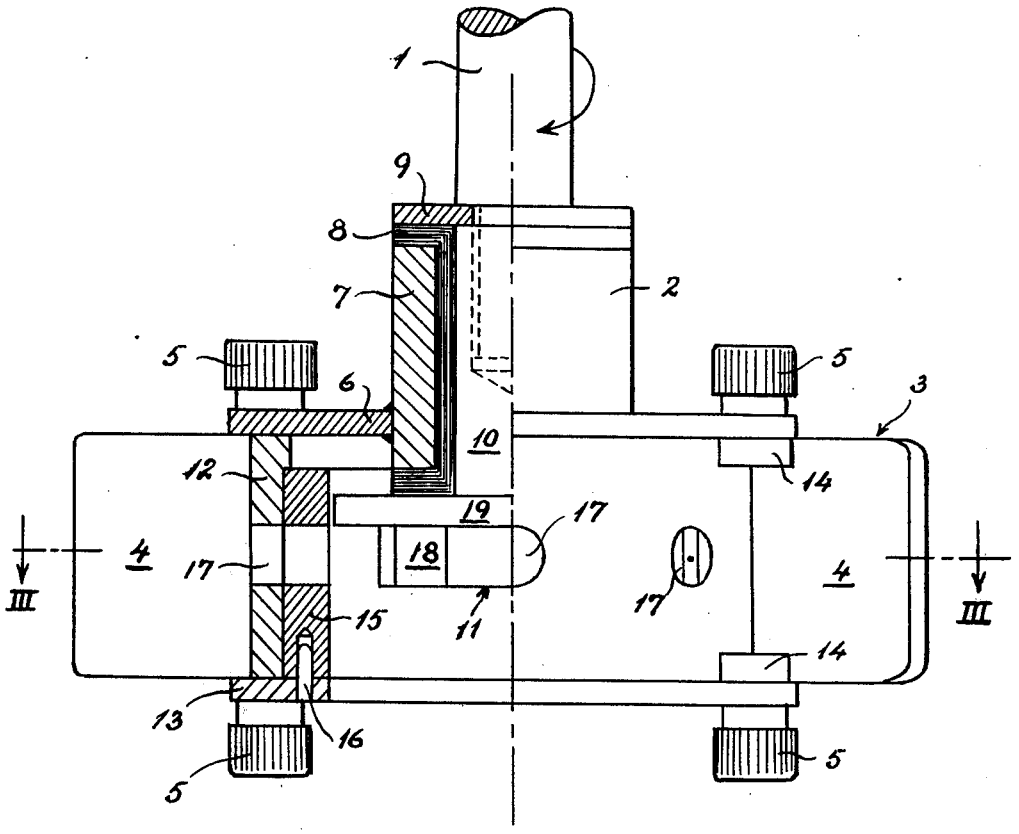
Figure 3:
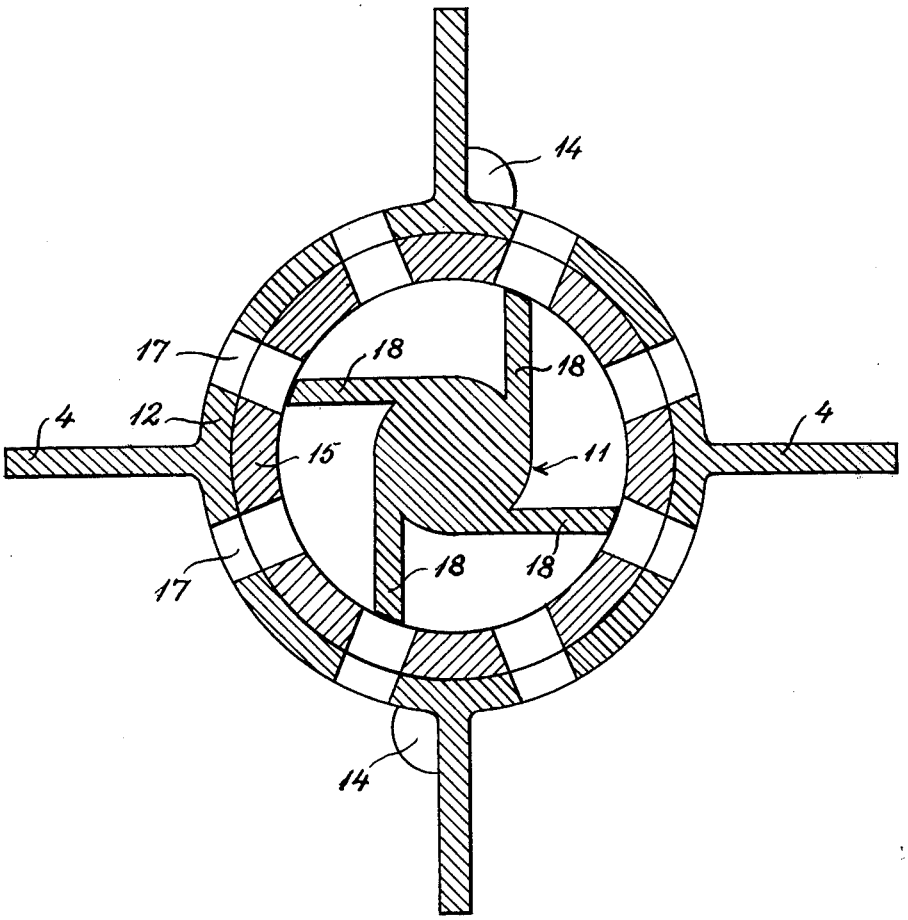
Figure 4:
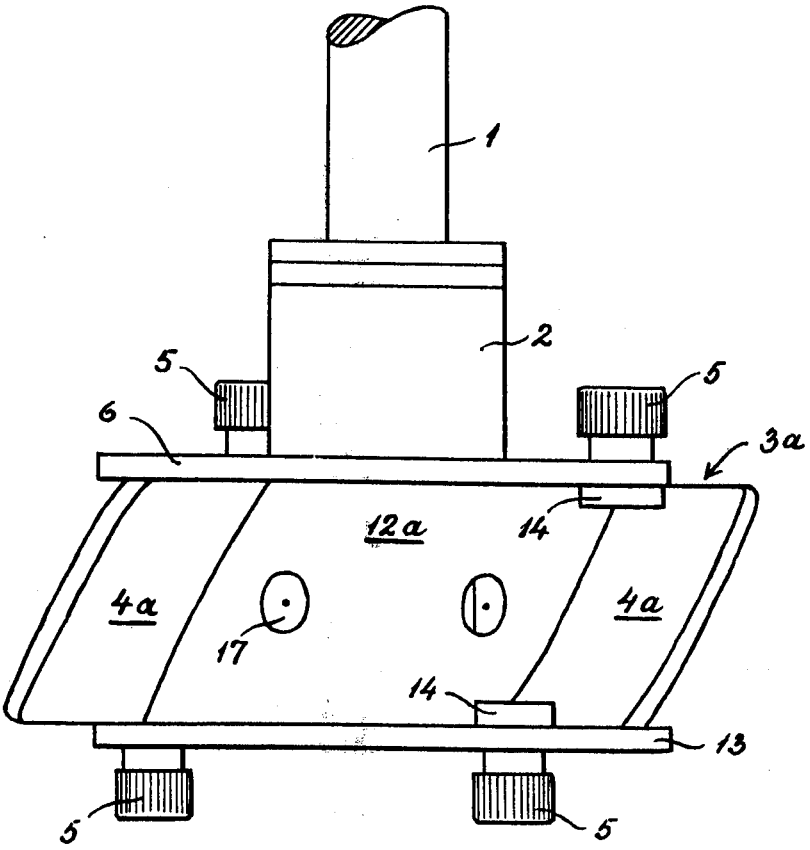

The invention will now be described in greater detail with reference to the drawing wherein FIG. 1 shows a plan view of the mixing head in one embodiment of the mixing unit according to the invention, FIG. 2 shows the mixing head of FIG. 1 in elevation as viewed in a direction at right angles to the line a—a of FIG. 1, the leftside half of the figure showing a section through the outer housing on the line II—II of FIG. 1, FIG. 3 shows a section on the line III—III of FIG. 2, and FIG. 4 shows a second embodiment of a mixing head for a mixing unit according to the invention, as seen in elevation.

FIG. 1 shows a section through a drive shaft 1 about which an outer housing with the general designation 3 is freely rotatable in a sleeve bearing 2. The housing 3 has four planar parts 4 protruding from its periphery and is furthermore arranged so that it can easily be taken apart, being assembled by means of knurled thumb nuts as at 5.

As will appear from FIG. 2, the outer housing comprises an upper plate 6 which is attached, e.g. by welding, to a central boss sleeve 7 positioned between a ring 9 and a plate-shaped part 19 by means of a bearing 8 which in the embodiment shown is formed as a slide bearing having collars, said ring 9 being firmly attached between a shoulder on the drive shaft 1 and an axially upwardly extending part 10 of a rotor 11. Furthermore, the outer housing 3 comprises an annular peripheral part 12 to which the protruding planar parts or blades 4 are attached, e.g. by welding, and a bottom part 13 which in the embodiment shown is formed as a ring, and which is secured to the annular part 12 by means of knurled thumb nuts 5 screwed on bolts attached to the annular peripheral part by means of brackets 14. Within the annular peripheral part 12 and abutting against a shoulder therein an annular insert 15 is placed whose positioning relative to the peripheral part 12 is secured by means of a pin 16 inserted into the bottom ring 13. Eight circular apertures 17 (see FIG. 3) equidistantly spaced along the periphery are provided in the annular peripheral part 12 and the annular insert 15. The rotor 11 has four vanes 18 which are positioned at the level of the apertures 17 (see FIGS. 2 and 3) beneath the circular plate-shaped part 19.

The embodiment shown and described operates in the following way:

After the mixing unit has been placed in the fluid material which is to be treated, a rotation in the direction shown by an arrow in FIG. 2 is imparted to the drive shaft 1 by a suitable driving means, e.g. an electric motor, the rotor 11 will rotate relative to the housing 3 whose rotation in the fluid material will be restrained by the protruding blades 4; thereby the vanes 18 will throw and press out fluid material through the apertures 17 in the housing 3, and at the same time the rotation of the housing in the fluid material will cause a stirring effect in the material.

In the embodiment shown in FIG. 4 the housing 3 has been replaced by a housing **3*a* which differs from the housing shown in FIGS. 1–3 in that — as shown in the figure — its annular peripheral part 12*a* has protruding planar parts or blades 4*a* extending at an oblique angle to the common axis of rotation of the housing 3*a* and the drive shaft 1**.

Provided the direction of rotation for the drive shaft 1 being the same as indicated in FIG. 2, such a direction of rotation in the fluid material is imparted to the housing **3*a* that the blades 4*a* cause an upward movement thereof. By placing the blades 4*a*** at a reversed oblique position, a downward movement of the fluid material may similarly be obtained. Thus, besides performing its primary function, the mixing unit according to the invention also acts as a propeller impeller and thereby contributes to a rapid and effective, uniform treatment of all of the fluid material.

From the foregoing it should be noted that the apparatus according to the invention may readily be effectively cleaned since, by unscrewing the knurled thumb nuts 5, the housing 3, **3*a* may be disassembled in its components 12, 12*a*, 13 and 15, whereupon such components as well as the rotor 11** may easily be cleaned effectively.

It will also be evident that the embodiment shown in FIGS. 1—3 as a matter of course may be converted to the one shown in FIG. 4 by replacing the annular peripheral part 12 of the housing 3 by a corresponding annular part **12*a*. Other embodiments of the annular peripheral part 12 are conceivable without departing from the scope of invention; it might, for instance, be provided with a different number of blades 4, 4*a*, and/or these might be given a different size and shape. Also the annular insert 15 may be readily replaced by another corresponding part, e.g. in case of wear, or it may be replaced by an insert of a different form with a view to making the mixing unit suitable for another mode of treating the fluid material. Thus, instead of circular apertures it may have a plurality of perforations, or its inner surface may consist of a perforated plate. Correspondingly, the apertures 17 in the annular peripheral part 12, 12*a*** may be differently formed. In this way, according to the invention, a very versatile unit is obtained which may readily be converted by the user from one field of application to another; advantages are also obtained as regards the manufacture and maintaining of a stock of mixing units since, with a basic unit and a limited number of interchangeable parts, it will be possible to construct mixing units for a considerable number of purposes.

The invention is not limited to the embodiments shown and described hereinbefore but also comprises others which — within the scope of the patent claims — will be obvious to a person skilled in the art from the foregoing specification and the drawings.

What is claimed is:

1. A mixing stirrer for mixing and treating liquid materials after being placed inside a container containing said liquid materials, comprising an outer housing comprising substantially a right cylindrical sidewall and two flat circular end plates with the sidewall defining openings for passage of said liquid materials and having disposed exteriorly thereof at least one outwardly radially extending flat paddle-like protrusion, a driven rotor having outwardly extending impeller blades mounted within said housing for rotation relative to said housing on a drive shaft adapted to be connected to a driving means with the axes of said right cylindrical sidewall, said rotor drive shaft, and said rotor being coaxial, said housing being mounted for free rotation relative to said rotor, as well as to said container, and said rotor acting to direct the liquid materials to be treated outwardly through said openings in said housing sidewall into an area adjacent said protrusions whereby the materials will be acted on by said protrusions and the rotation of said housing in said liquid material will be restrained.

2. A mixing unit as set forth in claim 1 in which there are a plurality of said protrusions that extend from the periphery of said housing, which protrusions are planar.

3. A mixing unit as set forth in claim 2 in which the protrusions extending outwardly from the periphery of said housing are planar and inclined at an oblique angle to the common axis of rotation of the housing and the drive shaft in such a way that when the outer housing rotates relative to the liquid material they will impart an upward or downward movement to the material relative to the mixing unit by acting as a helicoid or propeller.

4. A mixing stirrer for mixing and treating liquid materials after being placed inside a container containing said liquid materials, comprising an outer housing assembly including a sidewall and defining openings for the passage of said liquid materials and having disposed exteriorly thereof at least one outwardly extending paddle-like protrusion, a driven rotor having outwardly extending impeller blades mounted within said housing for rotation relative to said housing on a drive shaft adapted to be connected to a driving means with the axes of said sidewall, rotor drive shaft, and rotor being coaxial, said housing being mounted for free rotation relative to said rotor, as well as to said container, and said rotor acting to direct the liquid materials to be treated outwardly through said openings in said housing into an area adjacent said protrusions whereby the materials will be acted on by said protrusions and the rotation of said housing in said liquid material will be restrained.

* * * * *